US010508326B2

(12) United States Patent
Chin et al.

(10) Patent No.: US 10,508,326 B2
(45) Date of Patent: Dec. 17, 2019

(54) HIGH-MANGANESE STEEL WITH SUPERIOR COATING ADHESION AND METHOD FOR MANUFACTURING HOT-DIP GALVANIZED STEEL FROM SAME

(75) Inventors: Kwang-Geun Chin, Gwangyang-si (KR); Sun-Ho Jeon, Gwangyang-si (KR)

(73) Assignee: POSCO, Pohang-si (KR)

( * ) Notice: Subject to any disclaimer, the term of this patent is extended or adjusted under 35 U.S.C. 154(b) by 736 days.

(21) Appl. No.: 14/240,943

(22) PCT Filed: Aug. 23, 2012

(86) PCT No.: PCT/KR2012/006713
§ 371 (c)(1),
(2), (4) Date: Feb. 25, 2014

(87) PCT Pub. No.: WO2013/032173
PCT Pub. Date: Mar. 7, 2013

(65) Prior Publication Data

US 2014/0209216 A1 Jul. 31, 2014

(30) Foreign Application Priority Data

Aug. 26, 2011 (KR) ..... 10-2011-0085845

(51) Int. Cl.

| | |
|---|---|
| ***C22C 38/38*** | (2006.01) |
| ***C22C 38/08*** | (2006.01) |
| ***C22C 38/04*** | (2006.01) |
| ***C22C 38/00*** | (2006.01) |
| ***C22C 38/02*** | (2006.01) |
| ***C22C 38/06*** | (2006.01) |
| ***C22C 38/14*** | (2006.01) |
| ***C22C 38/58*** | (2006.01) |
| ***C22C 38/28*** | (2006.01) |
| ***C22C 38/32*** | (2006.01) |
| ***C22C 38/34*** | (2006.01) |
| ***C22C 38/50*** | (2006.01) |
| ***C22C 38/54*** | (2006.01) |
| ***C23C 2/02*** | (2006.01) |

(52) U.S. Cl.
CPC ..... *C22C 38/08* (2013.01); *C22C 38/008* (2013.01); *C22C 38/02* (2013.01); *C22C 38/04* (2013.01); *C22C 38/06* (2013.01); *C22C 38/14* (2013.01); *C22C 38/28* (2013.01); *C22C 38/32* (2013.01); *C22C 38/34* (2013.01); *C22C 38/38* (2013.01); *C22C 38/50* (2013.01); *C22C 38/54* (2013.01); *C22C 38/58* (2013.01); *C23C 2/02* (2013.01)

(58) Field of Classification Search
CPC ..... C22C 38/02
See application file for complete search history.

(56) References Cited

U.S. PATENT DOCUMENTS

| | | | | |
|---|---|---|---|---|
| 6,387,192 | B1 | 5/2002 | Frommeyer et al. | |
| 2003/0145911 | A1 | 8/2003 | Hoffmann et al. | |
| 2008/0271823 | A1 | 11/2008 | Hofmann et al. | |
| 2009/0010793 | A1 | 1/2009 | Becker et al. | |
| 2009/0053556 | A1 | 2/2009 | Sohn et al. | |
| 2009/0202382 | A1 * | 8/2009 | Kim | C21D 6/004 420/74 |

FOREIGN PATENT DOCUMENTS

| | | | | |
|---|---|---|---|---|
| CN | 101346480 | A | | 1/2009 |
| CN | 101760712 | A | | 6/2010 |
| EP | 1 979 500 | | | 2/2012 |
| JP | 58-197256 | A | | 11/1983 |
| JP | 58197256 | A | * | 11/1983 |
| JP | 4-259325 | | | 9/1992 |
| KR | 10-2007-0067593 | | | 6/2007 |
| KR | 10-2007-0067950 | | | 6/2007 |
| KR | 10-2007-0107138 | | | 11/2007 |
| KR | 10-2009-0070509 | | | 7/2009 |
| KR | 10-2011-0009792 | | | 1/2011 |
| KR | 10-2011-0066689 | | | 6/2011 |
| KR | 20110066689 | A | * | 6/2011 |
| KR | 10-2011-0087800 | | | 8/2011 |
| KR | 10-2012-0074145 | | | 7/2012 |
| WO | WO 93/13233 | | | 7/1993 |
| WO | WO 99/01585 | | | 1/1999 |
| WO | WO 02/101109 | | | 12/2002 |
| WO | WO 2009/084793 | A1 | | 7/2009 |

OTHER PUBLICATIONS

English Machine Tranlsation of JP 58197256 A of Sasaki Nov. 1983.*
English Machine Tranlsation of KR 20110066689 A of Chin Kwang Geun Jun. 2011.*
English machine translation via EPO of KR101329925 (B1) of Chin et al., published Nov. 14, 2013. (Year: 2013).*
Human English language partial translation dated Aug. 16, 2019 by USPTO Scientific and Technical Information Center (STIC) of foreign priority document KR 10-2011-0085845 with filing date of Aug 26, 2011 by POSCO (Year: 2011).*
Office Action dated Apr. 15, 2015 in corresponding Chinese Application No. 201280052599.2.
International Search Report from the Korean Patent Office for International Application No. PCT/KR2012/006713, dated Feb. 7, 2013.
European Search Report dated Mar. 12, 2015 in corresponding European Patent Application No. 12827282.0, 5 pages.

* cited by examiner

*Primary Examiner* — Jophy S. Koshy
(74) *Attorney, Agent, or Firm* — Cantor Colburn LLP

(57) ABSTRACT

There is provided a high-manganese steel with superior coating adhesion and a method of producing a hot-dip galvanized steel sheet from same. According to an aspect of the present disclosure, a high-manganese steel is characterized by including, by weight, C: 0.3-1%, Mn: 8-25%, Al: 1-8%, Si: 0.1-3.0%, Ti: 0.01-0.2%, Sn: 0.06-0.2%, B: 0.0005-0.01%, with the remainder being Fe and inevitable impurities. The present disclosure can provide a high-manganese and hot-dip galvanized steel sheet with superior surface quality as well as with high strength and workability by preventing coating failures that may be caused by manganese.

7 Claims, No Drawings

HIGH-MANGANESE STEEL WITH SUPERIOR COATING ADHESION AND METHOD FOR MANUFACTURING HOT-DIP GALVANIZED STEEL FROM SAME

TECHNICAL FIELD

The present disclosure relates to a high-manganese steel with superior coating adhesion and a method for manufacturing a hot-dip galvanized steel sheet from the same, and more particularly, to a high-manganese steel having superior coating adhesion as well as high ductility and high strength, used for automobile bodies and structural members and prevents coating failures by minimizing formation of an oxide film on a surface thereof in a hot-dip galvanizing using the high-manganese steel, and a method for manufacturing a hot-dip galvanized steel sheet from same.

BACKGROUND ART

As high strengthening of automobile bodies and structural materials is required in view of improvements in fuel efficiency and stability resulting from the lightening of automobiles, many kinds of high strength steels for automobiles have been developed. However, since high strengthening decreases ductility in most steel sheets, many types of steel sheets resultantly have many limitations in the processing thereof to form parts. To solve the problem of a decrease in ductility due to the high strengthening of steel sheets, many studies have been undertaken, and as a result of the studies, austenite-based high-manganese steel (see JP1992-259325, WO93/013233, WO99/001585, WO02/101109, and the like) has been proposed in which 5-35% by weight of manganese is contained in steel to induce twin boundary defects deformation during plastic deformation of steel, thereby remarkably improving ductility.

Then, the high-manganese steel has a problem in that the coating adhesion of the hot-dip galvanized steel may be relatively poor. That is, since hot-dipped galvanizing of a steel sheet improves corrosion resistance, weldability and paint coatability, a majority of steel sheets for automobiles are hot-dip galvanized. Then, hot-dip galvanized steel sheets which use high-manganese steel as a material to be galvanized are annealed in a nitrogen atmosphere containing hydrogen for the securing of desired material qualities and surface activation (reduction). Such an atmosphere is a reducing atmosphere with respect to matrix iron (Fe) that is a material to be galvanized but acts as an oxidizing atmosphere with respect to elements which are easily oxidizable, such as manganese (Mn), silicon (Si), aluminum (Al), and the like, in high-manganese steel. Therefore, when high-manganese steel containing a large amount of Al, Si, and the like, as well as Mn being annealed for recrystallization in such an atmosphere, alloy elements are selectively oxidized by a trace of moisture or oxygen contained in the atmosphere to form a Mn, Al, Si surface oxide layer on a surface of the matrix material (to be galvanized). Thus, when high-manganese steel containing a large amount of Al, Si, and the like is used as a material to be galvanized, coating failures occurs due to a surface oxide formed during an annealing process that is a pre-coating process, or even in the case that a galvanized layer is formed, the galvanized layer may be delaminated during a processing process.

To date, as publicly disclosed art related to preventing coating failures of a high-manganese and hot-dip galvanized steel sheet, there are provided 1) a plating method (Korean Patent Application Publication No. 2007-0067950) in which silicon (Si) is added to form a thin Si oxide film on a surface, thus suppressing the formation of an Mn oxide, 2) a method (Korean Patent Application Publication No. 2007-0107138) in which a 50 nm to 1000 nm of aluminum layer is deposited by a physical vapor deposition (PVD) followed by annealing to prevent the formation of an Mn oxide, and the like.

However, since in the case of method 1, Si has a higher oxidation potential than Mn to form a stable film type oxide, it is impossible to improve wettability with molten zinc. Also, since method 2 requires a vacuum deposition process followed by annealing for galvanizing, Al, a material to be galvanized, is easily oxidizable, and the deposited Al forms an oxide having poor wettability due to moisture or oxygen contained in the annealing atmosphere, method 2 may rather deteriorate galvanizability.

As described above, in the existing publicly disclosed art, when high-manganese steel containing a large amount of Mn is used as a plating material, since thick Mn, Al, Si oxides or composite oxides thereof formed during the annealing cause coating failures, or a galvanized layer is formed, the galvanized layer simply covers a thin oxide layer without an interfacial inhibition layer at an interface between the plating layer iron, coating delaminations in which the galvanized layer is separated from matrix iron during a processing process may occur.

DISCLOSURE

Technical Problem

An aspect of the present disclosure may provide a high-manganese steel with superior coating adhesion, which prevents coating failures while satisfying requirements for high strength and high ductility.

An aspect of the present disclosure may also provide a method for manufacturing a hot-dip galvanized steel sheet from the above-described high-manganese steel in which coating failures are suppressed.

Technical Solution

According to an aspect of the present disclosure, a high-manganese steel may include, by weight %: C: 0.3-1%; Mn: 8-25%; Al: 1-8%; Si: 0.1-3.0%; Ti: 0.01-0.2%; Sn: 0.06-0.2%; and B: 0.0005-0.01%, with the remainder being Fe and unavoidable impurities.

The high-manganese steel may further at least one of Ni: 0.01-2% and Cr: 0.01-2.0%.

According to another aspect of the present disclosure, a method for manufacturing a hot-dip galvanized steel sheet, the method may include: preparing a steel sheet having a composition including, by weight %: C: 0.3-1%; Mn: 8-25%; Al: 1-8%; Si: 0.1-3.0%; Ti: 0.01-0.2%; Sn: 0.06-0.2%; and B: 0.0005-0.01%, with the remainder being Fe and unavoidable impurities; annealing the steel sheet under conditions having a dew point temperature of −30° C. to −60° C. and an annealing temperature of 750° C. to 850° C.; and dipping the annealed steel sheet in a hot dip galvanizing bath including Al: 0.2-0.25% by weight at a dipping temperature of 480° C. to 520° C.

The high-manganese steel may further at least one of Ni: 0.01-2% by weight and Cr: 0.01-2.0% by weight.

Advantageous Effects

As set forth above, according to exemplary embodiments of the present disclosure, a high-manganese and hot-dip galvanized steel sheet with superior surface quality as well as with high strength and workability may be provided by preventing occurrence of coating failures due to alloy elements such as a large amount of Mn, Al, and Si.

BEST MODE

Hereinafter, embodiments of the present disclosure will be described in detail. The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

The inventors have found that for obtaining high-manganese steel with superior mechanical properties while preventing the occurrence of coating failures, the compositions of C, Al, Si, Ti, Sn, B, and the like, in addition to a high content of manganese, need to be controlled to be within proper ranges, and have completed this invention.

That is, the inventors have confirmed from studies that with a determination that the formation of an annealing oxide is not only suppressed by a reducing atmosphere (strictly speaking, an oxidizing atmosphere with respect to alloy elements) in annealing and the occurrence of coating failures due to the annealing oxide is not prevented, high-manganese steel with superior coating adhesion as well as superior strength and ductility may be obtained by adding an element capable of preventing occurrence of coating failures and setting the content of the element in consideration of synergy with another element added in order to allow high-manganese steel to exhibit strength and ductility, and have developed the steel of this invention.

That is, the present disclosure is characterized by controlling the compositions of high-manganese steel, and more particularly, the compositions of C, Mn, Si, Ti, Sn, B, and the like, as follows.

Hereinafter, the reason for which the components of a matrix steel sheet are selected and limited in range will be described. It should be noted that the content of each component is expressed in percentage (%) by weight unless otherwise specified.

C: 0.3-1%

Carbon (C) is a component contributing to the stability of austenite, is advantageous as the added amount thereof increases, and is preferably added in an amount of 0.3% or more so as to obtain the adding effect. However, when the added amount of C exceeds 1%, the stability of an austenite phase greatly increases to decrease workability, due to transition of deformation behavior by slip. Therefore, the upper limit of C is preferably limited to 1%.

Mn: 8-25%

Mn is an essential element of high-manganese steel which remarkably improves ductility while increasing strength because it induces twining when the steel is plastically deformed due to the austenite phase stability. To obtain such an effect, it is advantageous that Mn be added in an amount of at least 8%. However, when the added amount of Mn exceeds 25%, high temperature ductility is decreased to generate cracking in a casting process, high temperature oxidation rapidly occurs in a reheating process for hot rolling to deteriorate the surface quality of the product, surface oxidation (selective oxidation) occurs in an annealing process followed by hot-dipped galvanizing to deteriorate plating properties, and production costs increase due to the large amount of Mn. Therefore, the added amount of Mn is limited to 25% or less.

Al: 1-8%

While Al is typically added as a deoxidizer, Al in the present disclosure is added to prevent delayed fracture. Al is a component to stabilize ferrite phase, but increases stacking fault energy in a slip plane of steel to suppress the formation of an s-martensite phase, thereby improving ductility and delayed fracture resistance. In addition, even when the added amount of Mn is low, since Al suppresses the formation of the s-martensite phase, Al contributes to the minimization of the added amount of Mn. To exhibit such an effect in high-manganese steel, Al is preferably added in an amount of 1% or more. However, when the added amount of Al exceeds 8%, Al suppresses the formation of twin, decreasing ductility and deteriorating castability in continuous casting, and also, since Al is an easily oxidizable element, Al is surface-oxidized in an annealing process followed by hot-dipped galvanizing to deteriorate wettability with molten zinc. Therefore, the upper limit of Al is limited to 8% or less.

Si: 0.1-3.0%

When silicon (Si) is added alone, Si is surface-saturated in an annealing process followed by hot-dipped galvanizing to form a dense film type Si oxide to deteriorate galvanizability and thus it is preferable that Si is not added. However, when Si is added in combination with Mn, film type Si oxide is restrained by Mn and is changed into particle type Si oxide, and the thickness of Mn oxide is also decreased. In order to obtain the above-described effect, the proper added amount of Si is 1-5 times greater than that of Mn ($Si/Mn \leq 0.2$), and when the added amount of Si exceeds this range, film type Si oxide and Mn oxide are formed and thus wettability is reduced in hot-dipped galvanizing to cause coating failures and coating delaminations. Therefore, an excessive addition of Si is not preferred. However, when the added amount of Si is 3% or more, the ductility of high-manganese steel is rapidly reduced. Therefore, the upper limit of Si is limited to 3% or less. Also, when the added amount of Si is less than 0.1%, a strength improvement effect is low. Therefore, the lower limit of Si is limited to 0.1% or more.

Ti: 0.01-0.2%

Titanium (Ti) is solid-solutioned in a columnar grain boundary to increase a melting temperature of an Al-saturated low melting point compound, thus preventing the formation of a liquid phase film at a temperature not higher than 1,300° C., and has a high affinity with nitrogen to act as a nucleus for precipitation of aluminum nitride (AlN) which is a cause of columnar grain boundary brittleness as coarse state, thus strengthening columnar grain boundary. However, when the added amount of Ti is less than 0.01%, there is no effect, and when the added amount of Ti exceeds 0.2%, an excessive amount of Ti is segregated in a grain boundary to cause a grain boundary embrittlement. Therefore, the added amount of Ti is limited to 0.01-0.2%.

Sn: 0.06-0.2%

Since tin (Sn) is a noble element and does not form a thin oxide film at high temperatures by itself, Sn is precipitated on a surface of a matrix in an annealing prior to a hot dip galvanizing to suppress a pro-oxidant element such as Al, Si, Mn, or the like from being diffused into the surface and forming an oxide, thereby improving galvanizability. However, when the added amount of Sn is less than 0.06%, the effect is not distinct and an increase in the added amount of Sn suppresses the formation of selective oxide, whereas when the added amount of Sn exceeds 0.2%, the added Sn causes hot shortness to deteriorate the hot workability. Therefore, the upper limit of Sn is limited to 0.2% or less.

B: 0.0005-0.01%

Boron (B) is solid-solutioned in a columnar grain boundary at 1000° C. or higher to suppress the creation and movement of vacancies, thus strengthening columnar grain boundaries. However, when the added amount of B is less than 0.0005%, there is no effect, and when the added amount exceeds 0.01%, B generates a large amount of carbides and nitrides to act as a nucleus for precipitation of aluminum nitride and thus help the precipitation of coarse aluminum nitride, thereby embrittling the grain boundaries. Also, in an aspect of galvanizability, when the added amount of B is 0.01% or more, boron oxide is formed by grain boundary saturation and oxidation in annealing followed by galvanizing. Therefore, the added amount of B is limited to 0.0005-0.01%.

In addition to the above-described useful component elements, impurities may be inevitably mixed in production of steel. In the present disclosure, inevitable mixing of such impurities is not limited, and representative impurities, for example, phosphorous (P), and sulfur (S) may be included in the following content ranges.

P, S: Each not More than 0.03%

Generally, P and S are elements which are inevitably included in production of steel, and thus the allowable range of each of P and S is limited to 0.03% or less. Particularly, since P is segregated to reduce the workability of steel, and S forms coarse manganese sulfide to generate defects such as flange cracks and to reduce hole expansion, the added amounts of P and S are suppressed by as much as possible.

In addition to the above composition, it is more preferable to control Ni and Cr components as follows. At least one of Ni and Cr may be added.

Ni: 0.01-2%

Since Nickel (Ni) increases the stability of austenite phase in an aspect of material, Ni suppresses the formation of α' martensite phase. Therefore, since Ni promotes the formation of twin in high-manganese steel having austenite phase even at room temperature, Ni contributes to an increase in strength and an improvement in ductility in a processing of steel. Also, since Ni is a noble element in an aspect of galvanizing, Ni is not autonomously oxidized at high temperatures but is precipitated on a surface of steel to suppress surface diffusion of easily oxidizable elements such as Al, Mn, Si, and the like, Ni, reduces the thickness of surface oxide and induces a change in composition, thus exhibiting superior wettability with molten zinc. While Ni should be added in an amount of at least 0.01% or more in order to obtain such an effect, an increase in the added amount of Ni sharply progresses an internal oxidation along grain boundaries to cause cracking during hot rolling and also increases the production costs. Therefore, the upper limit of Ni is limited to 2%.

Cr: 0.01-2.0%

Chromium (Cr) forms a passive film in air to suppress corrosion like Si and prevents decarburization of carbon in steel during high temperature hot rolling to suppress the formation of α' martensite on a surface of a steel sheet, thereby improving the formability of steel. Therefore, it is preferable that Cr be added in an amount not less than 0.01%. However, when the added amount of Cr that is a ferrite stabilizing element is increased to 2% or more, the formation of α' martensite phase is rather promoted to decrease the ductility of steel. Also, in an aspect of galvanizing, when Cr is added, Cr oxide formed directly under the surface prevents surface saturation and oxidation of Mn, Si and Al having poor galvanizability to improve galvanizability, but when the added amount of Cr is large, a thick composite oxide film of which main portion is Cr oxide is formed to deteriorate wettability with molten zinc and cause coating failures or coating delamination. Therefore, the upper limit of Cr is limited to 2%.

It has been described in the present disclosure that superior coating adhesion may be obtained by the composition including C, Mn, Al, Si, Ti, Sn, B, and the like. However, as described above, when at least one of Ni and Cr is added, the coating failures and peeling off of coating of a hot-dip galvanized steel sheet may be further improved. Hereinafter, the reasons will be described in detail.

The inventors observed influences on the galvanizability of high-manganese steel (hereinafter briefly referred to as 'base steel') including C: 0.65%, Mn: 15%, Si: 0.6%, Al: 2%, Ti: 0.1%, B: 0.001%, P: 0.017%, S: 0.0005%, with the remainder being substantially Fe, and another steel in which a trace of elements such as Sn, Ni, Cr, and the like, were added to base steel.

First, in the case of high-manganese and hot-dip galvanized steel sheets which were hot-dip galvanized by using, as a material to be galvanized, base steel to which a noble element, such as Sn, Ni, and the like, was not added, a lot of coating failures occurred. The inventors have investigated a cause of coating failures in the base steel and have confirmed that a thick Mn oxide film or Al oxide film was formed on portions in which coating failures occurred. Such a thin oxide film was also observed at an interface of portions in which the galvanized layer was formed, and when a bend test (workability test) was performed, coating delamination in which the coated layer was completely peeled off from matrix iron occurred.

This is because the wettability of molten zinc with a thick film type Mn or Al oxide layer formed in an annealing process is reduced to cause coating failures, or although the coating failure portion is locally galvanized, an interfacial inhibition layer is not formed at an interface between the galvanized layer and the matrix iron in a state in which the galvanized layer simply covers a thin oxide film.

Therefore, the inventors have performed studies in order to solve the problem of coating failures and coating delamination in high-manganese and hot-dip galvanized steel sheets and have found that it is possible to produce a high-manganese hot dipped galvanized steel sheet free of coating failures and coating delamination by annealing and then hot-dipped galvanized high-manganese steel in which 0.06-0.2% of Sn is added to the composition of the base steel. This is because the composition or thickness of surface (annealing) oxide is greatly changed by addition of Sn. That is, since Sn is a noble element, Sn is not oxidized during high temperature annealing but is precipitated on the surface of the steel sheet to suppress the surface diffusion of easily oxidizable elements, such as Al, Mn, Si, and the like, in the matrix iron, thereby decreasing the thickness of the surface oxide and changing the composition of the surface oxide, it may be understood that Sn exhibits superior wettability with molten zinc.

For this, it is preferable that a Sn-saturated layer forms a thin film on a surface of a material to be galvanized in annealing. That is, when the added amount of Sn is less than 0.06%, the Sn-saturated layer is non-uniformly formed and thus have a difficulty in preventing the surface diffusion of oxidative elements such as Al, Mn, Si, and the like, so that the elements diffuse into the surface to form Al and Mn oxide films (Al—O, Mn—O) and thus wettability with molten zinc is poor to cause coating failures.

On the contrary, when the added amount of Sn is 0.06% or more, the Sn-saturated layer is uniformly formed in annealing to suppress the surface diffusion of easily oxidizable elements such as Al, Mn, Si, and the like, decrease the thickness of surface oxide to 10 nm or less, and change the composition of oxide into Mn oxide having a relatively good wettability with molten zinc, so that coating failures and coating delamination do not occur.

Also, in a case where one or both of Ni: 0.01-2.0% and Cr: 0.01-2.0% is added to base steel, it is possible to produce a high-manganese and hot-dip galvanized steel sheet free of coating failures and coating delamination in galvanizing after annealing in general production conditions.

This effect is greater when any one or both of Ni and Cr are added in combination than when Sn is added alone, because a thinner surface oxide is formed when any one or both of Ni and Cr are added in combination. That is, Ni is a noble element like Sn, and is precipitated on a surface of a matrix to suppress the surface diffusion of Al, Mn, Si, and the like, in matrix iron, thereby greatly reducing the thickness of surface oxide. In order to obtain the above-described effect, the added amount of Ni should be at least 0.1% or more, and in that case, since the surface oxide is formed to about 5 nm that is very thin due to a synergy effect with Sn, the hot-dipped galvanizability is much superior.

Galvanizability is much superior particularly when Cr is added to high-manganese steel in which Sn and Ni are contained. Since Cr is not a noble element such as Sn and Ni, when Cr is added alone to high-manganese steel, a thick Al—Cr—Si—Mn—O composite oxide film is formed, but when Cr is added together with Sn or Sn and Ni, a Cr oxide (an internal oxide) is formed directly under the surface of the matrix iron to prevent surface saturation and oxidation of Mn, Si and Al having a relatively poor galvanizability, so that the thickness of the surface oxide film is decreased to 5 nm or less to exhibit superior galvanizability in hot-dipped galvanizing.

That is, when an existing high-manganese steel sheet in which a large amount of Al and Si as well as Mn are added is annealed at high temperatures followed by a galvanizing process, a thick oxide film having a two-layered structure of Al oxide (Al—O) and Mn oxide (Mn—O) having poor wettability with molten zinc is formed to cause coating failures and coating delamination in a processing process, but in base steel of the present disclosure in which Sn is added or when Ni and Cr are added alone or in combination to the base steel, since Mn oxide (Mn—O) having a relatively good wettability with molten zinc is formed and the thickness of oxide is gradually decreased, it is possible to produce a hot dipped galvanized steel sheet with high manganese with superior galvanizability and coating adhesion.

When the high-manganese steel of the present disclosure having the above-described advantageous characteristics is hot-dip galvanized, the formation of Al, Mn, and Si oxides is suppressed on a surface of the high-manganese steel to improve the coating adhesion, so that a hot-dip galvanized steel sheet with superior surface appearance may be obtained. In the case where a steel sheet having the advantageous characteristics of the present disclosure is hot-rolled or cold-rolled and then is hot-dip galvanized by a general method, a hot-dip galvanized steel sheet with superior surface appearance may be obtained, but a more preferred method for obtaining a hot-dip galvanized steel sheet will be described below.

An atmosphere dew point temperature of an annealing process followed by a hot-dipped galvanizing process is preferably set to a range of −60° C. to −30° C., and a recrystallization annealing temperature is preferably set to a range of 750° C. to 850° C. When the atmosphere dew point temperature of the annealing process exceeds −30° C., matrix iron (Fe) as well as Mn is oxidized to form a thick oxide film, and thus coating delamination occurs. On the contrary, when the atmosphere dew point temperature is less than −60° C., selective oxidation of Mn or Si is suppressed but selective oxidation of Al that is a main cause of coating failures and coating delamination of high-manganese steel may easily occur. Also, in order to keep the atmosphere dew point temperature at a temperature lower than −60° C., a plurality of apparatuses for removing moisture of gas or oxygen are required and are not preferred.

When the annealing temperature is less than 750° C., it is difficult to secure the material quality, and thus the temperature is not preferred. When the annealing temperature exceeds 850° C., the material is softened, a selective oxidation layer is formed due to the surface saturation and oxidation of an alloy element such as Mn, Si, Al, and the like, and a much greater amount of Sn or Ni should be added in order to prevent such an oxidation layer from being formed. Therefore, the annealing temperature exceeding 850° C. is not preferred.

After the steel sheet is annealed as above, dipping of the steel sheet in a hot dip galvanizing bath is performed to galvanize the steel sheet. In this regard, a proper temperature at which a material to be galvanized is dipped in a hot dip galvanizing bath, i.e., a steel sheet dipping temperature, is properly 480° C. to 520° C., and a proper concentration of Al in the hot dip galvanizing bath is 0.2% by weight to 0.25% by weight. When the annealed material is dipped in the hot dip galvanizing bath, in order to allow Fe in the matrix iron and Al in the hot-dipped galvanizing bath to preferentially react with each other, an oxide film on a surface of the matrix iron should be eliminated and solid-solutioned in the hot-dipped galvanizing bath. However, when the oxidation layer is too thick or the dipping temperature is low, the oxide layer is not eliminated, so that wettability with molten zinc is poor and thus coating failures occur. In order to prevent the occurrence of such coating failures, it is required that the incoming temperature of the steel sheet be 480° C. or higher. This is because the higher the incoming temperature of the steel sheet, the easier the elimination of the oxide layer. However, when the incoming temperature of the steel sheet exceeds 520° C., excessive iron is eluted from the matrix iron and reacts with Zn or Al in the galvanizing bath to form Fe—Zn-based bottom dross and Fe—Al-based floating dross, and a portion of these drosses is mixed into the galvanized layer to deteriorate the surface appearance. Therefore, an incoming temperature exceeding 520° C. is not preferred.

When an annealed steel material (steel sheet) is dipped in the galvanizing bath, Al in the galvanizing bath preferentially reacts with the steel sheet to reduce an oxide film remaining on the surface of the steel sheet and to form an Fe—Al—Zn—Si—Ni-based layer which is a soft interfacial inhibition layer, thus playing a role in suppressing the growth of a brittle Zn—Mn—Fe-based intermetallic compound. In order to obtain the above-described advantageous effect, the concentration of Al in the galvanizing bath is preferably 0.2% by weight or more. Therefore, it is advantageous to manage the concentration of Al in the galvanizing bath at 0.2% by weight or more, but when the concentration of Al exceeds 0.25%, Fe—Al-based floating dross may be easily generated and a flow pattern looking like the galvanized layer flowing down is generated. Therefore, the upper limit of Al is limited to 0.25%.

That is, according to the present disclosure, a high-manganese steel material in which Sn is added is annealed in an annealing atmosphere to form a small amount of oxide within a range badly influencing on the coating adhesion, and then is hot-dip galvanized to produce a high-manganese and hot-dip galvanized steel sheet free of coating failures and coating delamination.

MODE FOR INVENTION

Hereinafter, the present disclosure will be described in more detail with examples thereof. It is noted that the following examples should be not construed to limit the scope of the present disclosure, but rather are only exemplarily provided to describe the present disclosure in more detail. The scope of the present disclosure is defined by claims and matters reasonably analogized from claims.

EXAMPLES

High-manganese steel having a composition, by weight, including C: 0.65%, Mn: 15%, Si: 0.6%, Al: 2%, Ti: 0.1%, B: 0.001%, P: 0.017%, and S: 0.0005%, and further including Sn, Ni, and Cr having compositions shown in Table 1 was dissolved in a vacuum to produce ingots, and the produced ingots were soaked at 1,100° C., hot rolled, and wound at 450° C. After pickling, the steel material was cold rolled at a reduction ratio of 45% to produce a steel sheet having a width of 200 mm and a thickness of 1.2 mm.

TABLE 1

| | Steel | | | Surface (annealing) oxide | | Coating quality | | |
|---|---|---|---|---|---|---|---|---|
| | Composition | | | | | Coating failures (Good | Coating adhesion (Good | |
| | | | | | Thickness | 1↔5 | 1↔5 | |
| No. | Sn | Ni | Cr | Composition | (nm) | Bad) | Bad) | Remarks |
| 1 | — | — | — | Al—O/Mn—O | 50 | Grade 5 | Grade 5 | Comp. Ex |
| 2 | 0.05 | — | — | Mn—Al—O | 40 | Grade 3 | Grade 2 | Comp. Ex |
| 3 | 0.06 | — | — | Mn—O | 20 | Grade 2 | Grade 2 | Example |
| 4 | 0.1 | — | — | Mn—O | 10 | Grade 1 | Grade 1 | Example |
| 5 | 0.2 | — | — | Mn—O | 10 | Grade 1 | Grade 1 | Example |
| 6 | 0.3 | — | — | Mn—O | 10 | Grade 1 | Grade 1 | Comp. Ex |
| 7 | — | 2.0 | — | Mn—Al—O | 40 | Grade 3 | Grade 3 | Comp. Ex |
| 8 | 0.06 | 0.01 | — | Mn—O | 20 | Grade 2 | Grade 1 | Example |
| 9 | 0.06 | 1.0 | — | Mn—O | 5 | Grade 1 | Grade 1 | Example |
| 10 | 0.06 | 1.5 | — | Mn—O | 5 | Grade 1 | Grade 1 | Example |
| 11 | 0.06 | 2.0 | — | Mn—O | 5 | Grade 1 | Grade 1 | Example |
| 12 | 0.06 | 2.5 | — | Mn—O | 5 | Grade 1 | Grade 1 | Example |
| 13 | 0.2 | 0.01 | — | Mn—O | 5 | Grade 1 | Grade 1 | Comp. Ex |
| 14 | 0.2 | 1.0 | — | Mn—O | 5 | Grade 1 | Grade 1 | Example |
| 15 | 0.2 | 1.5 | — | Mn—O | 5 | Grade 1 | Grade 1 | Example |
| 16 | 0.2 | 2.0 | — | Mn—O | 5 | Grade 1 | Grade 1 | Example |
| 17 | 0.2 | 2.5 | — | Mn—O | 5 | Grade 1 | Grade 1 | Comp. Ex |
| 18 | — | — | 0.3 | Al—Cr—Si—Mn—O | 120 | Grade 5 | Grade 5 | Comp. Ex |
| 19 | 0.06 | — | 0.01 | Mn—O | 25 | Grade 2 | Grade 2 | Example |
| 20 | 0.06 | — | 1.0 | Mn—Cr—O | 10 | Grade 1 | Grade 1 | Example |
| 21 | 0.06 | — | 1.5 | Mn—Cr—O | 10 | Grade 1 | Grade 1 | Example |
| 22 | 0.06 | — | 2.0 | Mn—Cr—O | 10 | Grade 1 | Grade 1 | Example |
| 23 | 0.06 | — | 2.5 | Mn—Cr—O | 40 | Grade 3 | Grade 2 | Comp. Ex |
| 24 | 0.2 | — | 0.01 | Mn—O | 5 | Grade 1 | Grade 1 | Example |
| 25 | 0.2 | — | 1.0 | Mn—Cr—O | 5 | Grade 1 | Grade 1 | Example |
| 26 | 0.2 | — | 2.0 | Mn—Cr—O | 10 | Grade 1 | Grade 1 | Example |
| 27 | 0.2 | — | 2.5 | Mn—Cr—O | 30 | Grade 3 | Grade 2 | Comp. Ex |
| 28 | 0.06 | 0.01 | 0.01 | Mn—O | 5 | Grade 1 | Grade 1 | Example |
| 29 | 0.06 | 0.01 | 2.0 | Mn—O | 5 | Grade 1 | Grade 1 | Example |
| 30 | 0.06 | 0.01 | 2.5 | Mn—Cr—O | 30 | Grade 3 | Grade 2 | Comp. Ex |
| 31 | 0.06 | 2.0 | 0.01 | Mn—O | 5 | Grade 1 | Grade 1 | Example |
| 32 | 0.06 | 2.5 | 0.01 | Mn—O | 5 | Grade 1 | Grade 1 | Comp. Ex |
| 33 | 0.2 | 0.01 | 0.01 | Mn—O | 5 | Grade 1 | Grade 1 | Example |
| 34 | 0.25 | 0.01 | 0.01 | Mn—O | 5 | Grade 1 | Grade 1 | Comp. Ex |
| 35 | 0.25 | 2.5 | 0.01 | Mn—O | 5 | Grade 1 | Grade 1 | Comp. Ex |
| 36 | 0.25 | 2.5 | 2.5 | Mn—Cr—O | 20 | Grade 2 | Grade 1 | Comp. Ex |

* Comp. Ex.: Comparative Example

These steel sheets were degreased and recrystallization-annealed at an annealing temperature of 800° C. for 40 seconds in a reducing atmosphere including 5% of hydrogen, with the remainder being nitrogen, and having a dew point temperature of −60° C.

The shape, thickness and composition of surface oxide in the steel sheets produced and annealed as above were observed and measured by using a focused ion beam (FIB) field emission-transmission electron microscopy (FE-TEM), an energy-dispersive X-ray spectroscopy (EDS), a glow discharge spectroscopy (GDS), etc, and the measurement results are shown in Table 1.

Thereafter, the surfaces of the annealed steel sheets produced via the above processes were hot-dip galvanized. The galvanizing treatment was performed by annealing test pieces under the above-described conditions, cooling the steel sheet to 500° C., dipping the steel sheet in a galvanizing bath having an Al concentration of 0.23%, and controlling the adhesion amount on one surface of the steel sheet to 60 g/m2 with an air knife (which is an apparatus for blowing air onto a surface of a steel sheet having a galvanized layer that is not completely solidified to control the thickness of the galvanized layer).

The evaluation of galvanizing quality was performed by evaluating occurrence of coating failures and good and bad of coating adhesion in the hot-dip galvanized steel sheets produced as above according to the following references.

In order to evaluate the degree of coating failures, the surface appearance was imaged to measure the size of a non-coated portion and the object steel sheets were graded according to the following criteria.

$1^{st}$ grade: No defect of coating failures $2^{nd}$ grade: Average diameter of non-coated portion is less than 1 mm $3^{rd}$ grade: Average diameter of non-coated portion is 1-2 mm.

$4^{th}$ grade: Average diameter of non-coated portion is 2-3 mm.

$5^{th}$ grade: Average diameter of non-coated portion is 3 mm or more

The coating adhesions of the hot-dip galvanized steel sheets were evaluated by performing an OT-bend test, then a taping test of an external winding portion and evaluating occurrence of delamination in the coated layer according to the following criteria.

$1^{st}$ grade: No delamination $2^{nd}$ grade: Delamination less than 5%

$3^{rd}$ grade: Delamination 5—less than 10%

$4^{th}$ grade: Delamination 10—less than 30%

$5^{th}$ grade: Delamination not less than 30%

Coating failure indices and coating adhesion indices of high-manganese and hot-dip galvanized steel sheets were evaluated and the evaluation results are shown in Table 1. In the evaluation results, in a case (Samples Nos. 3-5) where the added amount of Sn in base steel was 0.06-0.2% which is within the added range defined in the present disclosure, a case (Nos. 8-11, 13-16) where Ni was added to base steel and the added amount of Ni was 0.01-0.2% which is within the added range defined in the present disclosure, a case (Nos. 19-22, and 24-26) where the added amount of Cr was 0.01-0.2% which is within the added range defined in the present disclosure, and a case (Nos. 28-29, 31, and 33) where Ni and Cr were added in combination to base steels and the added amount of each of Ni and Cr was 0.01-0.2% which is within the added range defined in the present disclosure, when the samples were annealed followed by galvanizing, since the samples had discontinuous oxides of Mn—O or Mn—Cr—O at a thickness not more than 20 nm, coating failures in the galvanizing did not occur, and it was also possible to produce hot-dip galvanized steel sheets free of coating delamination in the processing thereof.

On the contrary, in a case (No. 1) where Sn was not added to base steel, a case (No. 2) where Sn was added but the added amount of Sn did not satisfy the lower limit of 0.06% defined in the present disclosure, a case (No. 7) where Sn was not added and Ni was added alone to base steel, and a case (No. 18) where Sn was not added and Cr was added alone to base steel, when the samples were annealed followed by galvanizing, since the samples had continuous thick surface oxides and the compositions of the formed oxides are Al-oxide, since Al—Mn-composite oxide and Al—Cr—Si—Mn—O composite oxide with poor wettability with molten zinc were formed, coating failures occurred during galvanizing and even when coated, the coated layer was delaminated during processing.

In a case (No. 6) where Sn was added and the added amount of Sn exceeded 0.2% that is the upper limit of Sn, in a case (Nos. 12 and 17) where in high-manganese steels in which Ni was added to base steels, the added amount of Ni exceeded 2% that is the upper limit defined in the present disclosure, and a case (Nos. 32 and 35) where in high-manganese steels in which Ni and Cr were added in combination to base steels, the added amount of Ni exceeded the upper limit defined in the present disclosure, since the surface oxide formed by annealing followed by galvanizing was discontinuous Mn oxide and had a thickness not more than 5 nm, coating failures in the galvanizing did not occur, and it was also possible to produce hot-dip galvanized steel sheets free of coating delamination in the processing thereof. However, in a case (No. 6) where the added amount of Sn exceeded the upper limit defined in the present disclosure, hot shortness occurred in reheating for hot rolling, and in a case (Nos. 12 and 17) where the added amount of Ni exceeded the upper limit, since internal oxidation sharply progressed to generate cracking during hot rolling, such compositions were not preferred.

Also, in a case (Nos. 23 and 27) where in high-manganese steels in which Cr was added to base steels, the added amount of Cr exceeded 2% that is the upper limit defined in the present disclosure and in a case (Nos. 30 and 36) where in high-manganese steels in which Ni and Cr were added in combination to base steels, the added amount of Cr exceeded the upper limit defined in the present disclosure, since thick composite oxide was formed to deteriorate wettability with molten zinc and to cause coating failures or coating delamination, such compositions are not preferred.

While exemplary embodiments have been shown and described above, it will be apparent to those skilled in the art that modifications and variations could be made without departing from the spirit and scope of the present disclosure as defined by the appended claims.

The invention claimed is:

1. A hot-dip galvanized steel sheet comprising:

a steel sheet comprising: by weight, C: 0.3-1%, Mn: 8-25%, Al: 1-8%, Si: 0.1-3.0%, Ti: 0.01-0.2%, Sn: 0.06-0.2%, B: 0.0005-0.01%, with the remainder being Fe and inevitable impurities, wherein the steel sheet has an Sn-precipitate layer formed on a surface of the steel sheet; and a galvanized layer formed on the Sn-precipitate layer of the steel sheet.

2. The hot-dip galvanized steel sheet of claim 1, wherein the steel sheet further comprises: by weight, at least one of Ni: 0.01 to 2% and Cr: 0.01 to 2.0%.

3. The hot-dip galvanized steel sheet of claim 2, further comprising: an Fe—Al—Zn—Si—Ni based layer between the galvanized layer and the Sn-precipitate layer.

4. A method for producing a hot-dip galvanized steel sheet, the method comprising:

preparing a steel sheet comprising, by weight, C: 0.3-1%, Mn: 8-25%, a first Al: 1-8%, Si: 0.1-3.0%, Ti: 0.01-0.2%, Sn: 0.06-0.2%, B: 0.0005-0.01%, with the remainder being Fe and inevitable impurities;

forming an Sn-precipitate layer on a surface of the steel sheet by annealing the steel sheet under conditions having a dew point temperature of −60° C. to −30° C. and an annealing temperature of 750° C. to 850° C. to form an annealed steel sheet having the Sn-precipitate layer on the surface thereof; and dipping the annealed steel sheet in a hot-dipped galvanizing bath at a dipping temperature of 480° C. to 520° C. to form a galvanized layer on the annealed steel sheet, wherein the hot-dipped galvanizing bath comprises: by weight, a second Al: 0.2-0.25%.

5. The method of claim 4, wherein the steel sheet further comprises, by weight, at least one of Ni: 0.01 to 2% and Cr: 0.01 to 2.0%.

6. The method of claim 5, wherein, during the forming, the Sn-precipitate layer suppresses diffusion of the first Al, the Mn and the Si of the steel sheet onto the surface of the steel sheet during the annealing to thereby form a surface oxide layer having a thickness of less than 10 nm.

7. The method of claim 6, wherein, during the dipping, the surface oxide layer is deoxidized by the second Al in the hot-dipped galvanizing bath and an Fe—Al—Zn—Si—Ni based layer is formed between the galvanized layer and the Sn-precipitate layer.

* * * * *